United States Patent [19]

Hudson

[11] 4,046,682

[45] Sept. 6, 1977

[54] TONER RECLAIMING SYSTEM

[75] Inventor: Frederick W. Hudson, West Henrietta, N.Y.

[73] Assignee: Xerox Corporation, Stamford, Conn.

[21] Appl. No.: 324,248

[22] Filed: Jan. 17, 1973

[51] Int. Cl.[2] ..... B07B 1/10

[52] U.S. Cl. ..... 209/250; 209/307; 209/370; 55/290

[58] Field of Search ..... 209/307, 250, 370; 55/351-354, 290; 355/15; 15/1.5, 347, 348, 349, 352, 256.51, 256.52; 118/637

[56] References Cited

U.S. PATENT DOCUMENTS

| | | | |
|---|---|---|---|
| 1,026,432 | 5/1912 | Dey | 209/250 |
| 1,287,433 | 12/1918 | Radford | 209/250 |
| 2,012,250 | 8/1935 | Rundell | 55/351 X |
| 3,233,391 | 2/1966 | Olsen | 55/290 |
| 3,410,060 | 11/1968 | Reilly | 355/15 UX |
| 3,472,002 | 10/1969 | Brown | 55/290 X |
| 3,534,427 | 10/1970 | Severynse | 15/1.5 X |
| 3,641,979 | 2/1972 | Geibasi | 118/637 |
| 3,744,450 | 2/1973 | Nard | 55/290 X |
| 3,793,986 | 2/1974 | Latone | 355/15 X |

*Primary Examiner*—Robert Halper

[57] ABSTRACT

Toner particles which are removed from a photoconductive drum are trapped by a moving filter at a toner collection station and on movement of the filter to a toner discharge station, the toner is discharged into a toner reservoir. The filter may be of such a size that only the toner particles which enhance image development will be trapped thereon while the smaller toner particles will pass therethrough.

4 Claims, 5 Drawing Figures

TONER RECLAIMING SYSTEM

DESCRIPTION OF THE INVENTION

This invention relates to particle reclaiming systems, and particularly to a toner reclaiming system that is particularly adapted for use with automatic copiers/reproducers capable of high speed operation.

It is, an object of this invention to provide a device for returning most of the residual toner cleaned from an electrostatic insulating plate to the developing system for reuse upon the plate.

Another object of this invention is to reclaim from the toner particles previously removed from an insulating plate only those particles which are of a size to provide maximum developability and to automatically convey those particles back into the developing system.

A better understanding of the invention as well as other objects of the invention will be apparent when the following detailed description of the invention is read in conjunction with the accompanying drawings wherein.

Figure 1:
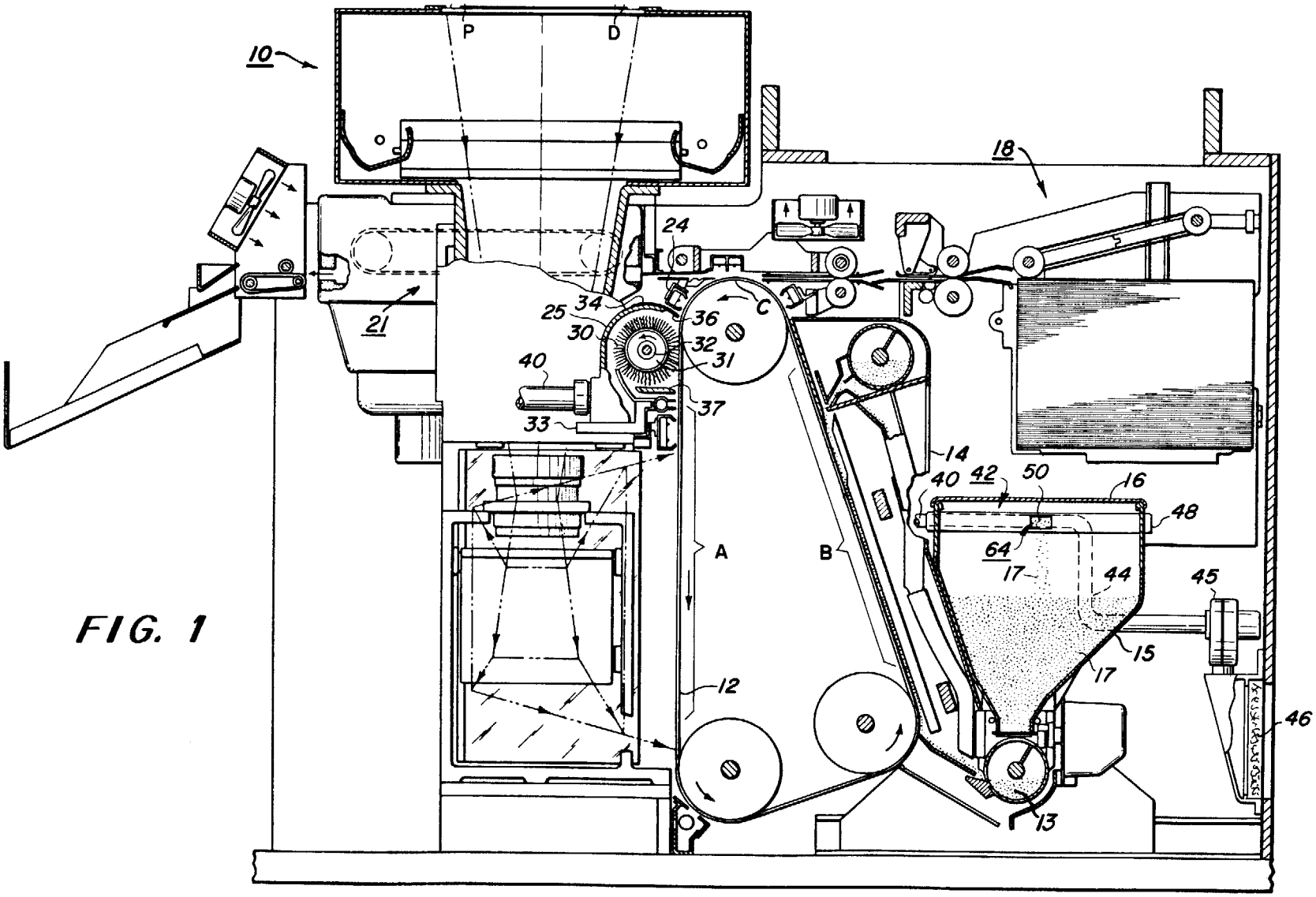
FIG. 1 is a schematic sectional view of a reproduction machine incorporating the present invention therein.
Figure 2:
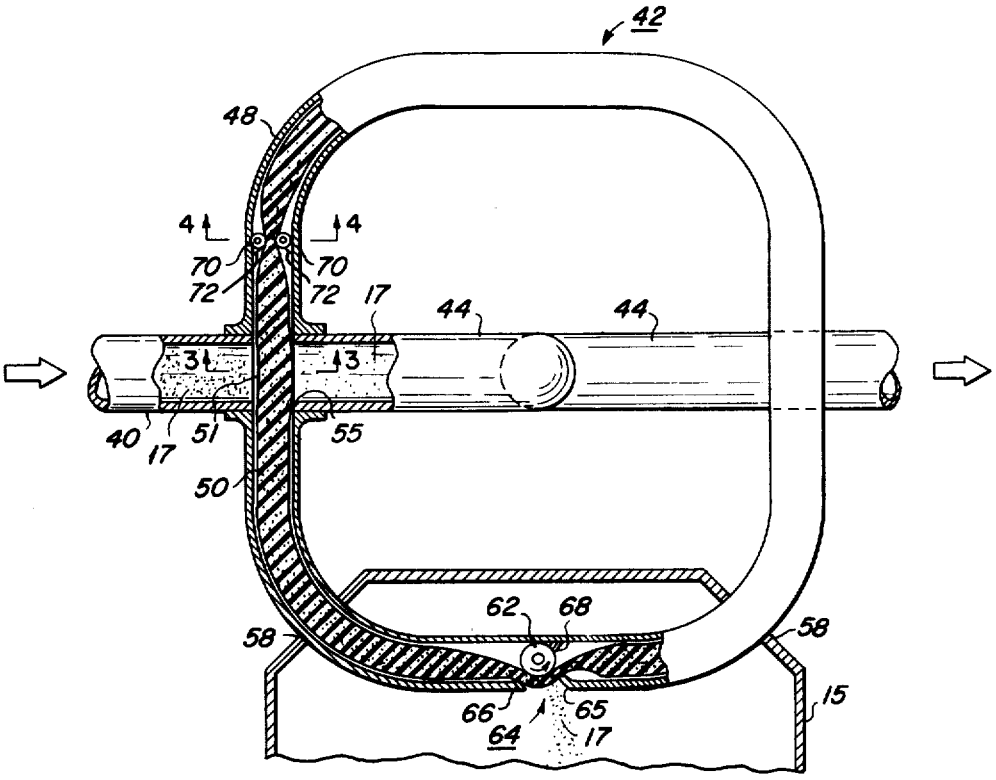
FIG. 2 is a simplified plan view of a toner reclaiming system.
Figure 3:
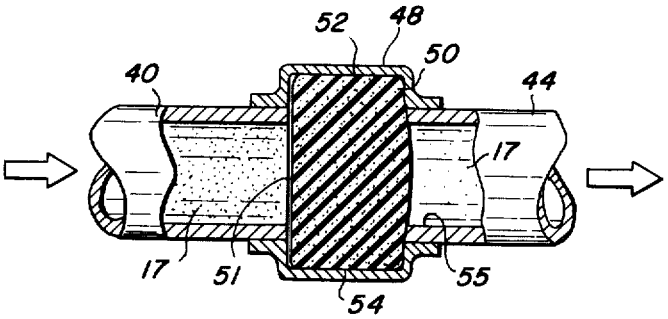
FIG. 3 is a sectional view taken along section line 3—3 of FIG. 2.
Figure 4:
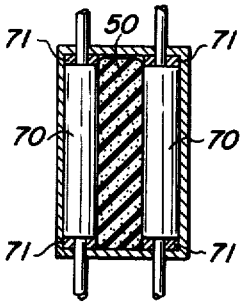
FIG. 4 is a sectional view taken along section line 4—4 of FIG. 2.
Figure 5:
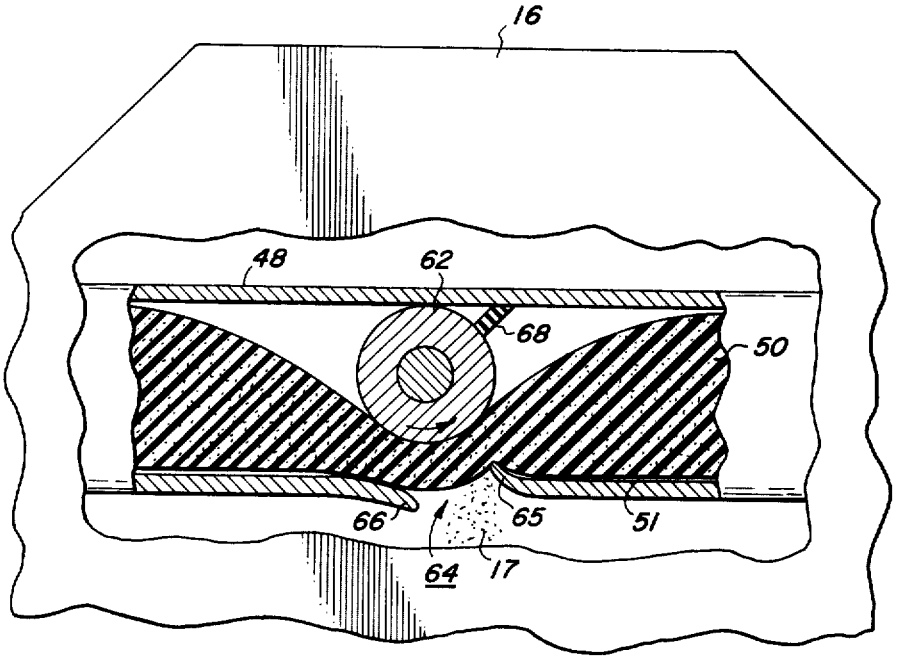
FIG. 5 is an enlarged cutaway plan view of a mechanism for discharging toner particles from a foam filter.

For a general understanding of the illustrated copier/-reproduction machine, in which the invention may be incorporated, reference is had to FIG. 1 in which the various system components for the machine are schematically illustrated.

In the illustrated machine, an original D to be copied is placed upon a transparent support platen P fixedly arranged in an illumination assembly, generally indicated by the reference numeral 10, positioned at the left end of the machine. An illumination system flashes light rays upon the original D on the platen P, thereby producing image rays corresponding to the informational areas on of the original. The image rays are projected by means of an optical system to an exposure station A for exposing the photosensitive surface of a moving xerographic plate in the form of a flexible photoconductive belt 12 having, say, a selenium surface coating.

The exposure of the belt surface to the light image discharges the photoconductive layer in the areas struck by light, whereby there remains on the belt a latent electrostatic image corresponding to the light image projected from the original D. As the belt surface continues its movement, the electrostatic image passes through a developing station B in which there is positioned a developer assembly generally indicated by the reference numeral 14. There, the belt 12 is maintained in a flat condition. The developer assembly 14 comprises horizontally and vertically conveying mechanisms which carry developer material 13 to the upper part of the belt assembly where the material is dispensed and directed to cascade down over the upwardly moving inclined selenium belt 12, thereby developing the electrostatic image.

As the developer material is cascaded over the belt like xerographic plate 12, toner particles 17 in the developer material are deposited on the belt surface to form powder images. As toner powder images are formed, additional toner particles are supplied to the developer material in proportion to the amount of toner deposited on the belt during xerographic processing. For this purpose, a toner dispenser and housing 15 therefor having a cover 16 thereon is used to accurately meter toner to the developer material 13 in the developer assembly 14.

The developed electrostatic image is transported by the belt 12 to a transfer station C where a sheet of copy paper is moved in speed synchronism with the moving belt in order to accomplish transfer of the developer image. There is provided at this station a suitable sheet transport mechanism adapted to transport sheets of paper from a paper handling mechanism, generally indicated by the reference numeral 18, to the developed image on the belt at the station B.

After the sheet is stripped from the belt 12, it is conveyed into a fuser assembly, generally indicated by the reference numeral 21, wherein the developed and transferred xerographic powder image on the sheet material is permanently affixed thereto. After fusing, the finished copy is discharged from the apparatus at a suitable point for collection externally of the apparatus.

The next and final station in the device is a belt cleaning station having positioned therein a corona precleaning device 24 similar to a corona charging device to impose an electrostatic charge on the selenium belt 12 and residual toner particles adherent thereto to aid in effecting the removal of the particles. A belt cleaning assembly 25 has an elongated rotatable brush 30 for removing any toner particles remaining on the xerographic belt after transfer. The elongated brush 30 is of such construction to apply extremely light pressure to the photoconductive surface of the selenium belt 12 and to dislodge any toner particles that may adhere thereto. The brush 30 preferably comprises a synthetic fur secured to a rigid cylinder 31 which is coating on a shaft 32 of a motor (not shown) mounted in the frame 33 of the machine. As shown, the brush 30 is rotatably supported in an elongated housing 34 secured to the machine frame 33.

For momentarily containing toner powder particles removed from the belt 12 by the belt cleaning assembly 25, the housing 34 encompasses approximately the entire brush area and is positioned so that its open side is essentially closed by the adjacent surface of the belt 12. In order to insure a substantially air tight relationship between the selenium belt 12 and the interior of the brush housing 34, the upper edge portion of the housing is provided with an adjustable seal plate 36 which may be moved circumferentially relative to the housing wall in order to permit close positioning of the leading edge of the seal plate to the selenium belt during operation. Similarly, the lower wall section of the housing is provided with an adjustable seal plate 37 which has a leading edge that may be moved toward and away from the belt 12 in order to minimize the spacing therebetween.

At the other end remote from the side thereof which faces the selenium belt, the housing 34 is formed with an exhaust opening which is in communication with an upstream conduit 40 of a toner reclaiming system 42. A downstream conduit 44 connects the toner reclaiming system 42 to an exhaust blower 45 having its outlet arranged to direct exhaust air out of the machine and into the surrounding atmosphere. A stationary filter 46 is in the path of movement of this exhaust air in order to ensure that only filtered air reaches the atmosphere. In conventional brush cleaning exhaust systems for electrostatic machines, the brush cleaner 30, the conduits 40, 44 and the exhaust blower 45 with the filter 46 comprise the usual electrostatic plate cleaning system. In the present invention, however, the toner reclaiming system 42 is interposed between a brush cleaner and its conventional exhaust system. It is believed that the foregoing description is sufficient for the purposes of this application to show the general operation of an electrostatic copier using a toner reclaiming system constructed in accordance with the invention. For further details concerning the specific construction of the electrostatic copier, reference made to U.S. Pat. No. 3,661,452 in the name of Hewes et al.

Referring now to FIGS. 2-5, the toner reclaiming system 42 comprises a generally elliptical filter housing 48 having a slidable belt filter 50 therein. The filter may comprise an open cell urethane foam of having a cell size selected to trap substantially all of the toner particles which are above 3 microns. Open cell foams made from other polymers having the required resiliency and tensile strength may also be utilized. The filter 50 slides in the housing between the upstream conduit 40 and the downstream conduit 44. The filter is so dimensioned that the top and bottom edges 52 and 54 thereof are in a sliding, sealing contact with the corresponding walls of the housing and also make a sliding and sealing contact with the opening 55 of the downstream conduit 44. The width of the filter is slightly less than the width of the housing 48. Suction generated by the exhaust blower 45 produces a flow of air in a path running from the cleaning chamber or housing 34, through the upstream conduit 40, then through the filter 50, the downstream conduit 44 and and finally past the stationary filter 46. As a result in toner particles are conveyed through the conduit 40 onto the outer face 51 of the filter 50. Substantially all particles above 3 microns by the filter 50, but the smaller particles pass therethrough and continue onward by through the conduit 44 to the stationary filter 46. Since the edges of the filter 50 slidingly engage the housing 48, toner particles will only lodge on the outer face 51 of the filter and will not accumulate on the edges thereof or bypass the filter into the downstream conduit 44. A portion of the filter housing 48 is located within the toner reservoir 15 which has a pair of slots 56 and 58 in opposite walls thereof which receive the filter housing thereto. Any type of well-known seals may be provided at these slots to seal the reservoir from outside contaminents. The elevation of the filter housing 48 in the reservoir is such that the cover 16 may be placed on the reservoir without interference from the filter housing. That portion of the filter housing which is located in the reservoir has an opening 64 through which the filter 50 extends. A roller 62 is positioned in the housing to move the filter 50 through the housing. An edge 65 of the opening is turned inwardly in order to squeeze the foam filter against the roller 62 in order to discharge toner particles 17 from the foam cells in the face 50 of the filter. The other edge 66 of the opening is positioned close to the roller so that the foam passing therebetween will be squeezed to provide a seal thereat. A lip seal 68 is secured to the housing and engages the roller 62 to effectively form a seal therebetween. A pair of rollers 70 are rotatably mounted in the housing 48. Lip seals 72 are secured to the housing and engage the rollers 70 to effectively form a seal therebetween. The filter 50 passes between the rollers 70 and is squeezed thereby to form a seal therebetween. A resilient seal 71 is provided at the upper and lower ends of the rollers 62 and 70. The rollers 62 and 70 are effectively connected by any well-known means (not shown) to a motor (not shown) for driving the same in a direction to move the filter belt 50 in a counterclockwise direction. While this is a preferred embodiment, the rollers and 70 could be eliminated, thereby relying upon the seal formed between the roller 62, the foam filter 50, the seal 68, and the edges 65 and 66, as a seal to maintain suction within the filter housing 48.

OPERATION

In operation, rollers 62 and 70 are driven by a motor to continuously move the foam filter 50 in a counterclockwise direction through the housing 48. Toner particles 17 which have been removed from the photoconductive belt surface by the brush 30, are sucked through the upstream conduit 40 to the filter 50 wherein substantially all toner particles above 3 microns are deposited in the cells on the face 51 of the filter and toner particles below that size are sucked through the filter into the downstream conduit 44 and are deposited on the stationary filter 46. The toner particles collected on the filter 50 are moved by the filter to the opening 64 of the filter housing 48 where they are discharged from the filter cells when the filter is squeezed by the inwardly extending lip 65 against the roller 62. Instead of an inwardly extending lip 65, a vibrating mechanism could be utilized to beat against the exposed foam filter to discharge the toner particles therefrom.

It is very advantageous to trap only toner particles of a size greater than 3 microns and deliver them to the toner reservoir as these size particles enhance image development. The smaller size particles are not desired and therefore are allowed to pass through the filter and out of the system to the stationary filter 46. Thus, it can be further seen that this system provides for reclaiming toner particles of a size which enhance development thereby upgrading the toner in the toner reservoir.

It can be seen from the above, that the filter system eliminates the need to frequently change filters as only a minute portion of the toner is directed to the stationary filter 46.

While the filter housing has been described as passing through the toner reservoir, the housing could be arranged to sit on the cover of the toner reservoir with appropriate changes in the cover being made to accommodate an opening therein which is sealed from outside contaminents and which will receive the toner being discharged from the filter.

What is claimed is:

1. In a copier having a photosensitive surface for supporting toner images, the combination comprising conduit means, cleaning means located in said conduit means for removing toner from said surface, a housing in communication with said conduit means, suction means in communication with said conduit means and said housing for conveying toner particles away from said cleaning means, a movable endless filter means disposed in said housing for trapping and passing toner particles above and below, respectively, a predetermined size, a development system including a reservoir for toner particles, an opening in said housing means communicating with said reservoir, means for discharging the trapped toner particles on said filter means through said opening into said reservoir, and means for moving said endless filter means through said housing.

2. The structure as recited in claim 1 wherein said endless filter has openings of a size to trap substantially all toner particles of a size above 3 microns, and further including a second filter means in said conduit means for trapping the toner particles passing through said endless filter means.

3. The structure as recited in claim 2 wherein said endless filter is an open cell polymeric foam.

4. The structure as recited in claim 1 wherein said endless filter is an open cell polymeric foam.

* * * * *